US011104505B2

(12) United States Patent
Moreau

(10) Patent No.: US 11,104,505 B2
(45) Date of Patent: Aug. 31, 2021

(54) DISPENSING AND APPLICATION HEAD FOR A FLUID PRODUCT

(71) Applicant: APTAR FRANCE SAS, Le Neubourg (FR)

(72) Inventor: Francis Moreau, Sotteville les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 31 days.

(21) Appl. No.: 16/486,615

(22) PCT Filed: Mar. 6, 2018

(86) PCT No.: PCT/FR2018/050504
§ 371 (c)(1),
(2) Date: Aug. 16, 2019

(87) PCT Pub. No.: WO2018/162832
PCT Pub. Date: Sep. 13, 2018

(65) Prior Publication Data

US 2020/0055661 A1 Feb. 20, 2020

(30) Foreign Application Priority Data

Mar. 9, 2017 (FR) ..... 1751920

(51) Int. Cl.
*B05C 11/00* (2006.01)
*B65D 83/28* (2006.01)
(Continued)

(52) U.S. Cl.
CPC ..... *B65D 83/285* (2013.01); *A45D 34/04* (2013.01); *B05B 11/0035* (2013.01);
(Continued)

(58) Field of Classification Search
CPC ..... B65D 83/285; B65D 83/30; A45D 34/04; B05B 11/0035; B05B 11/0089; B05B 11/3032
(Continued)

(56) References Cited

U.S. PATENT DOCUMENTS 9,155,372 B2 * 10/2015 Gieux ..... A45D 34/04
9,498,042 B2 * 11/2016 Villarreal ..... A45D 34/041
(Continued)

FOREIGN PATENT DOCUMENTS

WO 2015/170048 A1 11/2015

OTHER PUBLICATIONS

International Search Report for PCT/FR2018/050504 dated May 9, 2018 [PCT/ISA/210].
(Continued)

*Primary Examiner* — Jennifer C Chiang
(74) *Attorney, Agent, or Firm* — Sughrue Mion, PLLC

(57) ABSTRACT

A dispenser and applicator head (T) for associating with a dispenser unit (P), such as a pump, and defining a longitudinal axis X, and a front face (f1) and a rear face (f2) on either side of the longitudinal axis X, the dispenser and applicator head (T) comprising a dispenser member (1) and an applicator pad (4), the dispenser member (1) defining a feed path (C) for connecting the dispenser unit (2) to a dispenser orifice (O), the applicator pad (4) being mounted on the fluid dispenser member (1), adjacent to the dispenser orifice (O);
the dispenser and applicator head being characterized in that the dispenser orifice (O) is arranged axially on the longitudinal axis X, above the applicator pad (4) that extends mainly over the front face (f1).

14 Claims, 3 Drawing Sheets

(51) Int. Cl.
*A45D 34/04* (2006.01)
*B05B 11/00* (2006.01)
*B65D 83/30* (2006.01)

(52) U.S. Cl.
CPC ..... *B05B 11/0089* (2013.01); *B05B 11/3032* (2013.01); *B65D 83/30* (2013.01); *A45D 2200/1018* (2013.01)

(58) Field of Classification Search
USPC ..... 401/264–266
See application file for complete search history.

(56) References Cited

U.S. PATENT DOCUMENTS

| | | | | |
|---|---|---|---|---|
| 2014/0234004 | A1 | 8/2014 | Thorpe et al. | |
| 2014/0376985 | A1 | 12/2014 | Villareal et al. | |
| 2018/0021795 | A1* | 1/2018 | Apodaca ..... | B05B 11/3014 222/340 |

OTHER PUBLICATIONS

International Preliminary Report on Patentability dated Sep. 12, 2019 issued by the International Bureau in International Application No. PCT/FR2018/050504.

* cited by examiner

DISPENSING AND APPLICATION HEAD FOR A FLUID PRODUCT

CROSS REFERENCE TO RELATED APPLICATIONS

This application is a National Stage of International Application No. PCT/FR2018/050504, filed on Mar. 6, 2018, which claims priority from French Patent Application No. 1751920, filed on Mar. 9, 2017.

The present invention relates to a dispenser and applicator head for associating with a dispenser unit, such as a pump, a valve, a squeezable tube, etc., so as to constitute a fluid dispenser and applicator assembly. Advantageous fields of application of the present invention are the fields of cosmetics, perfumery, and pharmacy.

In the prior art, document EP 2 739 181 is known, in particular, which describes a dispenser and applicator head including an applicator pad that is made of a heat-transfer material, such as metal or ceramic, so as to impart a cold sensation to the skin. A fluid dispenser orifice is formed, either through the applicator pad, or just below the applicator pad. In addition, the applicator pad is incorporated, by overmolding, in the body of the head that is made out of plastics material. It should also be observed that the dispenser orifice opens out sideways, in particular when the dispenser orifice is situated below the applicator pad. In addition, the dispenser orifice opens out into a lateral zone that is wide, such that the user experiences some difficulty in depositing the fluid accurately in the desired location. Specifically, the lateral orientation of the dispenser orifice and its arrangement in a wide zone, such as the applicator pad, does not make it easy for the user to locate the dispenser orifice accurately, such that the user does not know exactly where the dispenser orifice is situated when the dispenser and applicator head is brought to the location at which it is desired to deposit the fluid before spreading it with the † Translation of the title as established ex officio. applicator pad. In addition, the dispenser and applicator head of the prior art does not offer any modularity, given that the applicator pad is mounted by overmolding. Furthermore, when the dispenser orifice is formed through the applicator pad, the arrangement of the dispenser orifice is naturally directly dependent on the applicator pad.

An object of the present invention is to overcome the above-mentioned drawbacks of the prior art by defining a dispenser and applicator head that makes it possible to deposit the fluid very accurately. Furthermore, mounting the applicator pad on the head should be simple and quick, so that several types of applicator pad can be mounted easily on the dispenser head.

To achieve these objects, the present invention proposes a dispenser and applicator head for associating with a dispenser unit, such as a pump, the dispenser and applicator head defining a longitudinal axis X, and a front face and a rear face on either side of the longitudinal axis X, the dispenser and applicator head comprising a fluid dispenser member and an applicator pad, the fluid dispenser member defining a fluid feed path for connecting the dispenser unit to a dispenser orifice via which the fluid leaves the dispenser member, the applicator pad being mounted on the fluid dispenser member, adjacent to the dispenser orifice, the dispenser orifice being arranged axially relative to the longitudinal axis X, above the applicator pad that extends mainly over the front face, the fluid dispenser member comprising a connector base and a mounting collar that co-operate with each other to define the fluid feed path, the applicator pad being mounted on the mounting collar.

The head thus comprises three discrete parts, namely a connector base that comes into engagement with the dispenser unit (pump), the mounting collar that co-operates with the connector base so as to form the fluid feed path, and the applicator pad that is mounted on the mounting collar. It should be observed that the three parts may be fitted together along the longitudinal axis X, such that assembling them together is extremely simple.

More precisely, the fluid feed path may comprise a bottom axial section that is defined entirely by the connector base, and a top section that is defined by both the connector base and the mounting collar, the top section being offset axially relative to the bottom axial section, such that the dispenser orifice is situated off the longitudinal axis X, the fluid feed path also comprising an interconnection section that is defined by both the connector base and the mounting collar, and that connects the bottom axial section to the top section. The bottom axial section may be arranged on the longitudinal axis X, and the top section may also extend axially but in a manner that is offset relative to the longitudinal axis X, the interconnection section making it possible to connect the bottom section and the top section together. Making the dispenser member out of two parts (a base and a collar) is justified mainly by the fact that it is difficult to make a fluid feed path that includes a deviation, through a single piece.

In still greater detail, the connector base may include a notched chimney that is engaged axially, in leaktight manner, in a cannula that is formed by the mounting collar, the cannula forming the dispenser orifice at its top end. Once assembled together, the base of the chimney and of the cannula form the interconnection section.

In another advantageous aspect of the invention, the mounting collar includes an axial mounting housing, and the applicator pad includes a mounting stud that is engaged axially in the axial mounting housing, the axial mounting housing advantageously including a housing wall, and the applicator pad advantageously includes a skirt that surrounds the housing wall. Thus, it can easily be understood that the applicator pad is fitted and mounted axially on the mounting collar along the longitudinal axis X. Engaging the stud in the housing enables the applicator pad to be well anchored on the mounting collar, and the intimate contact of the skirt around the housing wall makes it possible to guarantee good stability of the applicator pad on the mounting collar.

In another advantageous aspect of the invention, the mounting collar includes an outer peripheral wall that forms a shaped edge that extends from the rear face to the front face, the applicator pad defining side edges and a bottom edge that meet the shaped edge substantially without discontinuity, the applicator surface projecting outwards relative to the shaped edge so as to form a convex curve, at least along the longitudinal axis X. Thus, it can be understood that the applicator surface is incorporated in the mounting collar without any line interruption. However, it should also be understood that the applicator surface may form a curve that is convex to a greater or lesser extent, but without deteriorating its smooth and continuous connection with the shaped edge of the mounting collar.

It should also be observed that the dispenser orifice is situated towards the top end of the dispenser and applicator head, and not through the applicator pad, nor axially below said applicator pad, as in the above-mentioned document EP 2 739 181. As a result of its pointed arrangement, the user can position the dispenser orifice accurately at the location at which it is desired to deposit the fluid, in the same way as with a finger or a pen.

It should also be observed that the applicator pad is a part that is separate from the fluid dispenser member and that is fitted and mounted on the fluid dispenser member beside the dispenser orifice that is formed by the fluid dispenser member. Thus, the applicator pad is not incorporated in the dispenser member, as would happen if the dispenser member was overmolded on the applicator pad, or vice versa. It is thus possible to mount applicator pads of various types on the dispenser member without modifying or altering the fluid feed path that is formed through the dispenser member only.

According to an advantageous characteristic of the invention, the dispenser orifice opens out, advantageously axially, into a top flat that forms the top end of the dispenser member, the applicator pad forming an applicator surface that meets the top flat without discontinuity. The dispenser orifice is thus arranged at the tip of the dispenser and applicator head, such that the user can easily locate it and position it accurately at the location at which it is desired to deposit the fluid. The top flat in which the dispenser orifice is formed may present a surface area that is considerably smaller than the surface area of the applicator surface of the applicator pad. It can thus be understood that the top flat is small and very localized at the top end of the dispenser member. The top flat may even be no more than the top edge that surrounds the dispenser orifice.

According to another advantageous characteristic of the invention, the applicator surface is curved, such that the top flat and the applicator surface present different orientations. The user can thus deposit fluid at the location at which it is desired, by orientating the dispenser and applicator head substantially perpendicularly to the target (skin), and can then change the orientation of the head relative to the target by sloping it, so as to bring the curved applicator surface against the target, at the location at which the fluid has been deposited. In other words, the fluid is deposited with the tip of the head and the fluid is spread with the front face of the head, with the orientation of the head being changed in order to do this, starting from a substantially perpendicular orientation and changing to a sloping or transverse orientation. It is thus possible, with a single dispenser and applicator head, to deposit the fluid very accurately, and then to spread it very effectively, quite simply by modifying the orientation of the head relative to the target (skin).

In another advantageous aspect, the top flat slopes towards the front face. Nevertheless, it remains that the dispenser orifice may still open out axially into the top flat. Together, the top flat and the applicator surface may thus describe an arc of a circle.

In a preferred embodiment, the top flat defines a bottom edge, and the applicator surface defines a top edge that comes into contact with the bottom edge, surrounding the dispenser orifice in part.

The present invention also defines a fluid dispenser comprising a fluid dispenser unit and a dispenser and applicator head as defined above, wherein the dispenser unit comprises a laterally-actuated pump that is provided with a stationary axial outlet on which the connector base is mounted, and with a lateral pusher that is situated on the same side as the rear face of the dispenser and applicator head. The user can thus take hold of the dispenser in the same way as a pen, holding it firmly between the thumb and the middle finger, so as to be able to press on the lateral pusher with the index finger. This enables the dispenser orifice to be positioned very accurately, in the same way as with a tip of a pen, given that learning to write has enabled everyone to handle this type of implement very accurately.

The spirit of the invention resides in the applicator pad being fitted and mounted (axially) on a mounting collar that, together with a connector base, forms a fluid feed path that opens out into a dispenser orifice that is situated axially above the applicator pad, advantageously on the same front face of the head. Arranging the dispenser orifice at the tip makes it possible to apply the fluid very accurately, and the applicator surface that is situated below the dispenser orifice, is easily used, merely by sloping the dispenser and applicator head relative to the target surface. An axially fitted pad is mounted mechanically on the dispenser member, which also enables great modularity, in the sense that various types of applicator pad can be mounted on a standard dispenser member. It should also be observed that the dispenser orifice is completely decoupled from the applicator pad.

The invention is described below more fully with reference to the accompanying drawings, which show an embodiment of the invention by way of non-limiting example.

The dispenser and applicator head of the present invention is referenced T in the figures. It has a two functions, namely dispensing fluid on a selected target surface, and spreading or smoothing the deposited fluid so that it covers a large area of the target surface in a thin layer.

Figure 1:
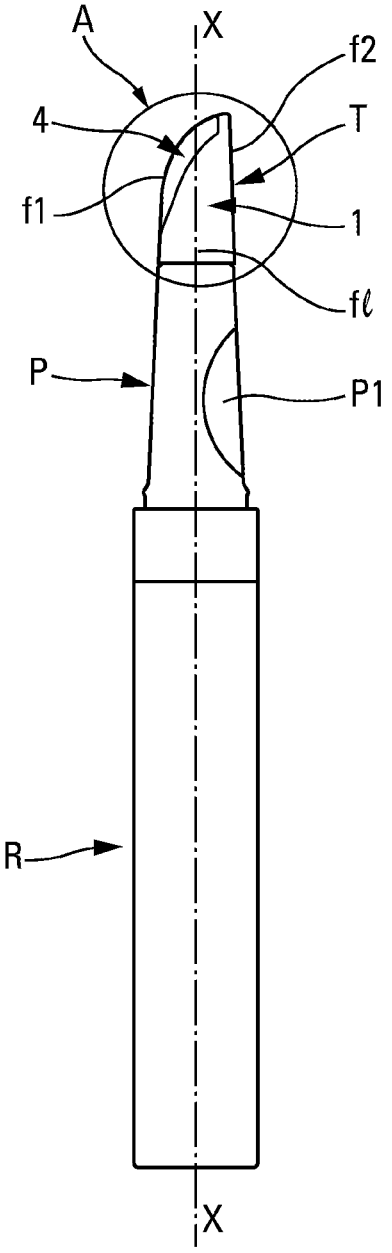
FIG. 1 is an elevation view of a fluid dispenser incorporating a dispenser and applicator head of the invention.
Figure 3:
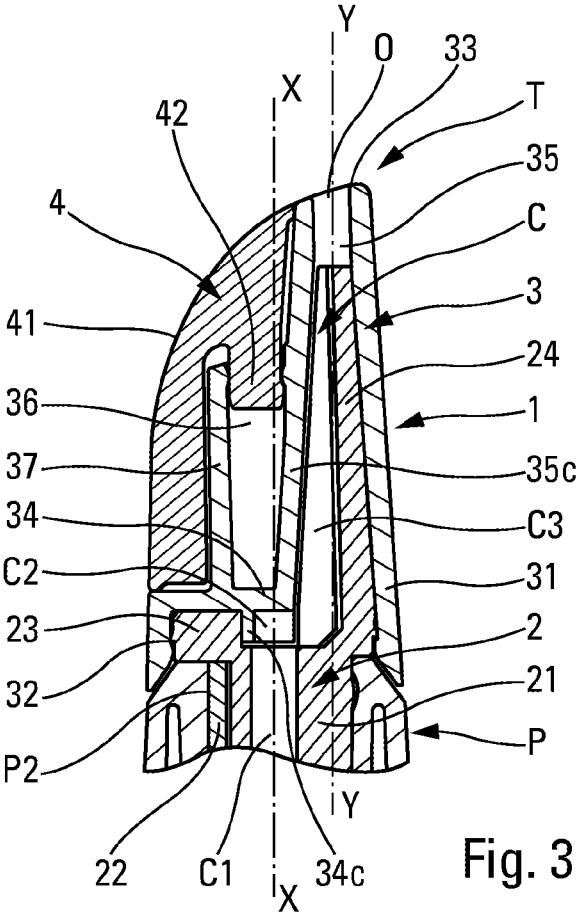
FIG. 3 is a vertical section view through the FIG. 2 dispenser and applicator head.
Figure 4:
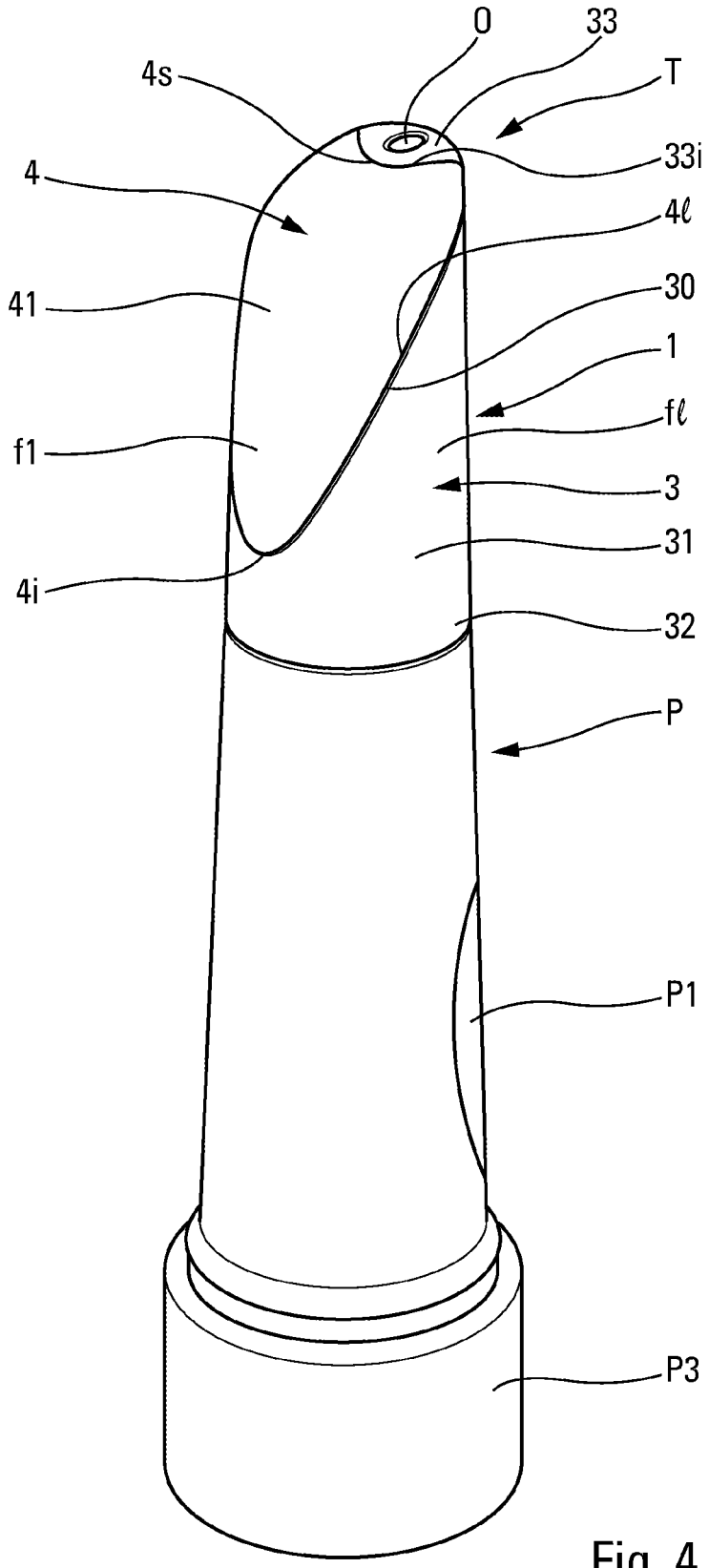
FIG. 4 is a much larger-scale perspective view of the dispenser and applicator head of the invention associated with a dispenser unit that includes a lateral pusher.

With reference to FIGS. 1 and 4, it can be seen that the dispenser and applicator head T is associated with a dispenser unit P that may be a pump, for example. The dispenser unit P includes a pusher P1 that is arranged laterally in this embodiment. The dispenser unit P is mounted on a reservoir R containing fluid to be dispensed. In FIG. 1, it can be seen that the dispenser unit P is situated between the reservoir R and the dispenser and applicator head T. The reservoir R, the pump P, and the head T together constitute a fluid dispenser that, in this embodiment, presents a configuration that is elongate along a longitudinal axis X. The axis X passes through the reservoir R, the pump P, and the head T. It should be observed that the head T is not circularly symmetrical, but, on the contrary, presents two opposite faces, namely a rear face f2 and a front face f1, that present different configurations. The head also defines two side faces Fl that are identical. It should be observed that the lateral pusher P1 of the dispenser unit P is situated on the same side as the rear face f2 of the head T. The front face f1 is mainly occupied by an applicator pad 4, by means of which the dispensed fluid may be spread or smoothed on the target surface. A user may take hold of the dispenser, holding it between the thumb and the middle finger, with the index finger arranged on the lateral pusher P1 so as to be able to actuate it. Such handling corresponds exactly to handling a pen, which users are used to doing very accurately. Thus, the dispenser with the head T of the invention may be used as accurately as a pen. Sloping a pen relative to a writing surface is completely natural, and the user slopes the dispenser in the same way so as to bring the pad 4 into contact with the target surface. With reference to FIG. 4, it can be seen that, at its top end, the head T includes a dispenser orifice O that opens out substantially axially. The dispenser orifice O is arranged in the proximity of the rear face f2, while tilting a little towards the front face f1. Thus, the user knows exactly where to find the dispenser orifice O and can orientate the dispenser substantially perpendicularly to the target surface so as to deposit the fluid. Then, the user slopes the dispenser a little relative to the target surface so as to bring the applicator pad 4 into contact with the fluid deposited on the target surface. This ergonomic movement results from the dispenser orifice O being arranged axially above the applicator pad 4, as can be seen clearly in FIGS. 3 and 4.

In greater detail, the dispenser and applicator head T of the present invention includes a fluid dispenser member 1 that is associated with the applicator pad 4. The dispenser member 1 forms the dispenser orifice O that is situated at the free top end of the head T, just above the applicator pad 4 that has a visible portion that forms an applicator surface 41 with which the fluid deposited via the dispenser orifice O is spread or smoothed on the target surface (skin). In FIG. 3 in particular, it should be observed that the dispenser orifice O opens out axially along a dispensing axis Y that extends parallel to the longitudinal axis X, but in offset manner. Specifically, it can be seen that the longitudinal axis X passes through the pad 4, and the dispenser orifice O is offset or off-center relative to the axis X.

In theory, the fluid dispenser member 1 could be made in the form of a single piece. However, for ease of molding, it is preferable to make the fluid dispenser member 1 out of two distinct parts, namely a connector base 2 and a mounting collar 3. The two parts are shown in FIG. 3, but also in FIGS. 5 and 6. They are fitted together, advantageously in axial manner along the longitudinal axis X, so as to form between them a fluid feed path C for feeding the fluid from the axial outlet P2 of the dispenser unit P to the dispenser orifice O. As can be seen in FIG. 3, the feed path C is not rectilinear but, on the contrary, it is sinuous, since it presents a bottom axial section C1 that extends along the longitudinal axis X and a top section C3 that extends along the dispensing axis Y that, as mentioned above, is offset relative to the axis X. In order to connect the bottom axial section C1 to the top section C3, an interconnection section C2 is provided that makes it possible to achieve the offset or step between the bottom section C1 and the top section C3. The bottom axial section C1 directly receives the fluid delivered by the dispenser unit P. Then, the fluid passes through the interconnection section C2 so as to pass through the top section C3 having a free top end that defines the dispenser orifice O. The feed path C thus forms a deviation, like a conventional chimney liner.

Figure 5:
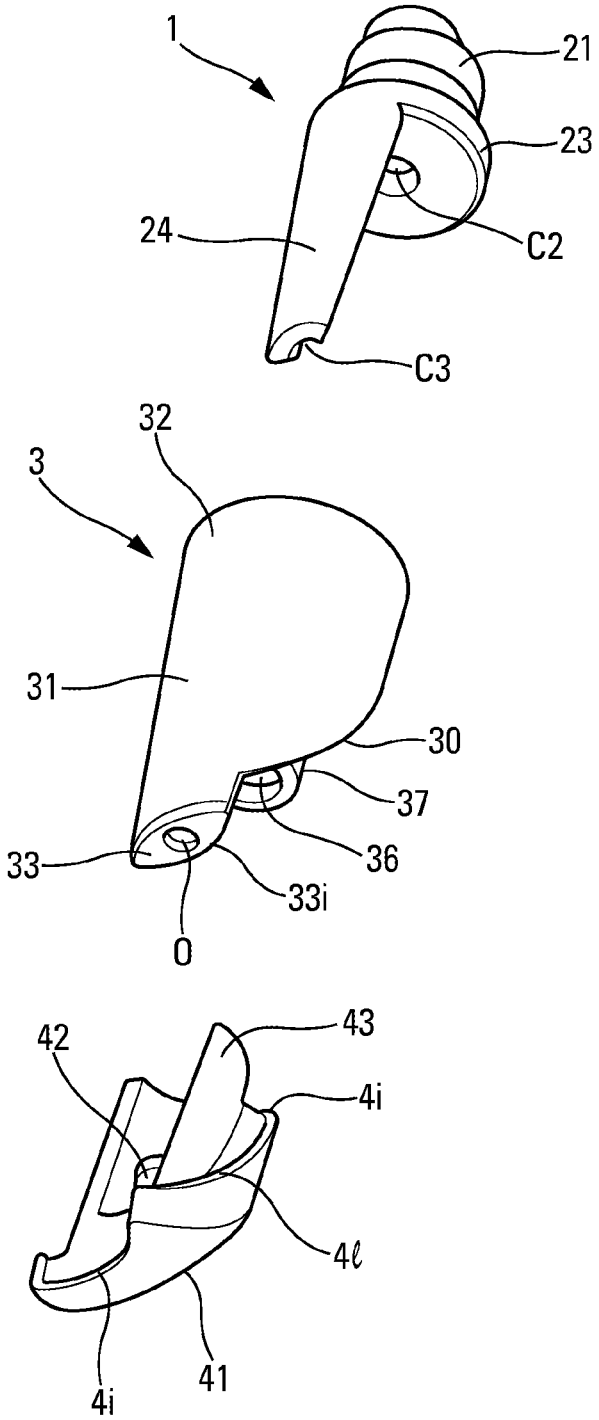
FIG. 5 is an exploded perspective view of the dispenser and applicator head of the invention in a first orientation.
Figure 6:
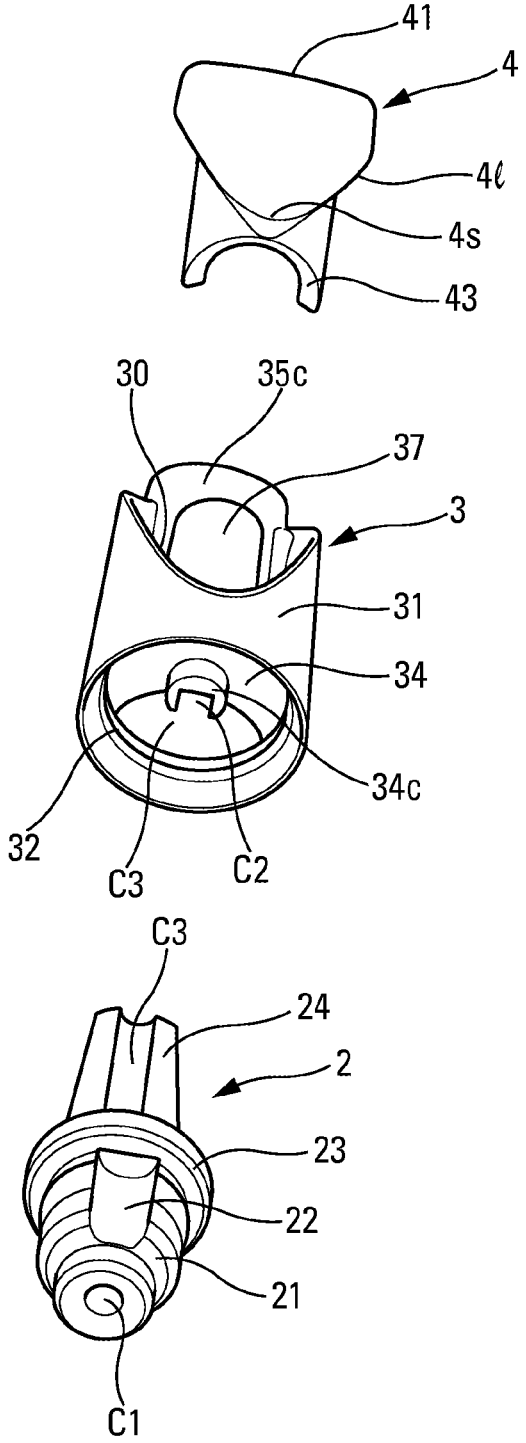
FIG. 6 is a view similar to the FIG. 5 view, in a second orientation.

The connector base 2 includes a connector anchor 21 that is engaged in stationary manner, e.g. by snap-fastening, in the axial outlet P2 of the dispenser unit P, as can be seen in FIG. 3. The bottom axial section C1 of the feed path C passes through the connector anchor 21. In FIG. 6, it should also be observed that the connector anchor 21 includes an axial groove 22, that is an indexer groove for indexing angular position, so as to be able to position the connector part angularly in the axial outlet P2 of the dispenser unit with the correct orientation, so that the rear face f2 of the head T is on the same side as the lateral pusher P1 of the dispenser unit P. Above the connector anchor 21, the connector base 2 defines a fastener collar 23 for fastening the mounting collar 3, as described below. An axial extension also passes through the fastener collar 23, which axial extension cooperates with the mounting collar 3 to form the interconnection section C2. The connector base 2 also forms a notched axial chimney 24 that extends axially in offset manner relative to the axis of symmetry of the connector anchor 21. This can be seen in FIG. 3, and in FIGS. 5 and 6. The notch of the chimney 24 extends into the fastener collar 23, so as to be able to communicate with the extension of the bottom axial section C1, which extension subsequently forms the interconnection section C2 together with the mounting collar 3.

The mounting collar 3 includes an outer peripheral wall 31 of shape that is generally cylindrical or slightly frustoconical. At its bottom edge, the outer peripheral wall 31 forms a fastener section 32 for coming into engagement with the fastener collar 23 of the connector base 2. At its top end, the outer peripheral wall 31 is provided with a top flat 33 into which the dispenser orifice O opens out. The top flat 33 forms the top end of the dispenser and applicator head T, in the shape of a kind of tip that is offset axially relative to the longitudinal axis X. The top flat 33 could be completely horizontal, i.e. perpendicular to the axis Y, but it is preferable to make the top flat 33 sloping a little towards the front face f1. Thus, it can be said that the rear face f2 is constituted only by the rectilinear portion of the outer peripheral wall 31 that is axially the highest up.

Figure 2:
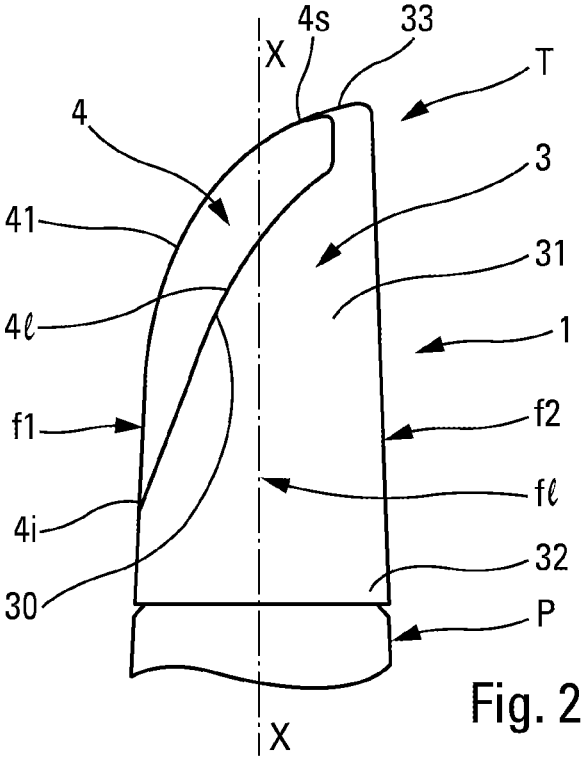
FIG. 2 is a view on a much larger scale showing a detail A of FIG. 1.

The outer peripheral wall 31 also defines a shaped edge 30 that extends from the top flat 33 into the proximity of the fastener section 32, as can be seen in FIGS. 2 and 3. It can even be said that the top end of the shaped edge 30 is formed by the bottom edge 33*i* of the top flat 33, as can be seen in FIGS. 4 and 5. As described below, the applicator pad 4 is mounted on the mounting collar 3 so as to complete the outer peripheral wall 31 at the shaped edge 30.

The mounting collar 3 also forms an axial flange 34*c* that is engaged inside the fastener collar 23 at the axial extension of the bottom axial section C1 so as to form the interconnection section C2. The mounting collar 3 also includes a cannula wall 35*c* that is connected to the outer peripheral wall 31 so as to form a cannula 35 in which the notched chimney 24 of the connector endpiece 2 is engaged, thereby forming between them the top section C3 of the feed path C. At its bottom end, the cannula 35 is connected to the interconnection section C2, so that communication is established between the interconnection section C2 and the top section C3. In FIG. 3, it should be observed that the cannula 35 extends along the axis Y that is offset relative to the longitudinal axis X.

The mounting collar 3 also includes a housing wall 37 that backs onto the cannula wall 35*c*, so as to define between them an axial mounting housing 36 that is open axially upwards.

The mounting collar C includes a radial plate 34 below which the fastener section 32 extends. The axial flange 34*c* also extends below the radial plate 34. In contrast, the cannula wall 35*c* backed onto the peripheral wall 31, and the housing wall 37 backed onto the cannula wall 35*c*, extend upwards from the radial plate 34. The cannula 35 passes through the radial plate 34 so as to establish communication with the axial flange 34*c*.

The applicator pad 4 initially defines an applicator surface 41, as mentioned above. The applicator surface 41 comprises a bottom edge 4*i*, a top edge 4*s*, and two symmetrical side edges 4*l*. The bottom edge 4*i* and the side edges 4*l* meet without discontinuity the shaped edge 30 of the peripheral outer wall 31, as can be seen in FIG. 4. The top edge 4*s* is also meets without discontinuity the bottom edge 33*i* of the top flat 33 into which the dispenser orifice O opens out. In FIG. 4, it should even be observed that the bottom edge 33*i* is convex, and the top edge 4*s* is concave, so that the applicator surface 41 surrounds the dispenser orifice O in part. It should also be observed that that applicator surface 41 presents a curved shape, whether this be in the axial direction or in the radial direction. It should even be observed that the applicator surface 41 runs on, in gentle and harmonious manner, from the opening formed by the shaped edge 30 of the peripheral outer wall 31. The applicator pad 4 could even merge into the peripheral outer wall 31, in so far as it is made of a material that presents an attractive appearance that is comparable or identical to the material of the mounting collar 3. The desired aim is that the contact between the edges of the applicator surface 41 and of the shaped edge 30 are as intimate, gentle, and continuous as possible. By way of example, it is possible to make the mounting collar 3 out of polyolefin (e.g. polyethylene (PE) or polypropylene (PP)), with decoration of the metal or tinted type in its bulk or lacquering, and also to make the applicator pad 4 out of polyurethane foam or out of elastomer with a surface treatment of the flocking type.

In the figures, it should be observed that the top flat 33, into which the dispenser orifice O opens out, presents an orientation that is generally or substantially axial, while the applicator surface 41 presents an orientation that diverges more and more away from the axis X on going towards the bottom edge 4*i*. It can even be said that the orientation at the top edge 4*s* is generally axial, while the orientation at the bottom edge 4*i* is generally perpendicular to the axis X. The fluid is thus dispensed with the dispenser and applicator head T being oriented substantially perpendicularly or orthogonally to the target surface, while the fluid is applied or smoothed with the dispenser and applicator head T sloping relative to the target surface. Changing the orientation of the head T is easy for the user, merely by adjusting the wrist. It should also be observed that the dispenser orifice O is situated at the tip of the head T, in the direct proximity of the rear face f2, in alignment with which is situated the lateral pusher P1 that receives the index finger of the user's hand. Thus, it can be said that the dispenser orifice O is situated in alignment with the user's index finger, thereby making it possible to deposit the fluid very accurately. Ergonomically, it can thus be said that the user has the impression of depositing the fluid in accurate manner with the fingernail and of smoothing the fluid with the fingerprint, which corresponds to a movement that is entirely intuitive. In addition, it should be observed that the dispenser and applicator head of the present invention presents a shape, in cross-section, that is substantially similar to the shape of an index finger, as can be seen in FIGS. 2 and 4. The top flat 33 is small and hard, as is the fingernail of the index finger, while the pad 4 may be soft and slightly deformable, as is the fingerprint of the index finger.

With reference once again to the figures, it can also be seen that the applicator pad 4 also includes an axial mounting stud 42 that extends axially downwards so as to become engaged in the axial mounting housing 36. By way of example, it is possible to provide snap-fastener profiles on the stud 42 for snap-fastening inside the housing 36. In addition, the applicator pad 4 may also be formed with a skirt 43 that comes to surround the housing wall 37 in intimate manner. By way of example, the skirt 43 may form a section of a cylinder that becomes engaged around the housing wall 37 that may also have the shape of a segment of a cylinder. Engaging the axial mounting stud 42 in the housing 26 makes it possible to fasten the pad 4 in secure and axial manner on the mounting collar 3, and engaging the skirt 43 around the housing wall 37 makes it possible to guarantee that the pad 4 is stable radially or against turning on the mounting collar 3. As a result of the axial orientation of the stud 42 and of the skirt 43, the applicator pad 4 is fitted axially along the longitudinal axis X onto the mounting collar 3, such that the two parts are extremely simple to assemble together. The same applies for assembling the mounting collar 3 and the connector base 2 that are interfitted along the longitudinal axis X. Finally, a dispenser and applicator head T is obtained having component parts that are all mounted in axial manner.

It should also be observed that it is extremely simple to mount applicator pads of various designs by using the same mounting technique (stud 42 and skirt 43). The fluid dispenser member 1 can thus be considered as a basic standard part to which various types of applicator pad can be associated, with different shapes and/or different materials as a function of the kind of application. By way of example, it is possible to provide an applicator pad made out of metal or out of ceramic so as to impart a cold effect, or an applicator pad made out of flexible material.

Although the present invention is described above with a dispenser and applicator head T associated with a pump having a lateral pusher P1, it is also possible to associate the dispenser and applicator head T of the present invention with another type of dispenser unit, such as a valve or a squeezable tube.

The invention provides a dispenser and applicator that takes advantage of the natural movements of the index finger of the hand. The user deposits the fluid with the tip of the head and then spreads the fluid with the side of the head (front face) that presents a curve comparable to the curve of the index finger.

The invention claimed is:

1. A dispenser and applicator head (T) for associating with a dispenser unit (P), the dispenser and applicator head (T) defining a longitudinal axis X, and a front face (f1) and a rear face (f2) on either side of the longitudinal axis X, the dispenser and applicator head (T) comprising a fluid dispenser member (1) and an applicator pad (4), the fluid dispenser member (1) defining a fluid feed path (C) for connecting the dispenser unit (P) to a dispenser orifice (O) from which the fluid leaves the dispenser member (1), the applicator pad (4) being mounted on the fluid dispenser member (1), adjacent to the dispenser orifice (O), the dispenser orifice (O) being arranged axially above the applicator pad (4) that extends mainly over the front face (f1);

wherein the fluid dispenser member (1) comprises a connector base (2) and a mounting collar (3) that co-operate with each other to define the fluid feed path (C), the applicator pad (4) being mounted on the mounting collar (3).

2. A dispenser and applicator head (T) according to claim 1, wherein the dispenser orifice (O) opens out into a top flat (33) that forms the top end of the dispenser member (1), the applicator pad (4) forming an applicator surface (41) that meets the top flat (33) without discontinuity.

3. A dispenser and applicator head (T) according to claim 2, wherein the applicator surface (41) is curved, such that the top flat (33) and the applicator surface (41) present different orientations.

4. A dispenser and applicator head (T) according to claim 2, wherein the top flat (33) slopes towards the front face (f1).

5. A dispenser and applicator head (T) according to claim 4, wherein the top flat (33) defines a bottom edge (33*i*), and the applicator surface (41) defines a top edge (4*s*) that comes into contact with the bottom edge (33*i*), surrounding the dispenser orifice (O) in part.

6. The dispenser and applicator head according to claim 2, wherein the dispenser orifice (O) opens axially into the top flat.

7. A dispenser and applicator head (T) according to claim 1, wherein the fluid feed path (C) comprises a bottom axial section (C1) that is defined entirely by the connector base (2), and a top section (C3) that is defined by both the connector base (2) and the mounting collar (3), the top section (C3) being offset axially relative to the bottom axial section (C1), such that the dispenser orifice (O) is situated off the longitudinal axis X, the fluid feed path (C) also comprising an interconnection section (C2) that is defined by both the connector base (2) and the mounting collar (3), and that connects the bottom axial section (C1) to the top section (C3).

8. A dispenser and applicator head (T) according to claim 7, wherein the connector base (2) includes a notched chimney (24) that is engaged axially, in leaktight manner, in a cannula (35) that is formed by the mounting collar (3), the cannula (35) forming the dispenser orifice (O) at its top end.

9. A dispenser and applicator head (T) according to claim 7, wherein the mounting collar (3) includes an axial mounting housing (36), and the applicator pad (4) includes a mounting stud (42) that is engaged axially in the axial mounting housing (36), the axial mounting housing (36) advantageously including a housing wall (37), and the applicator pad (4) advantageously includes a skirt (43) that surrounds the housing wall (37).

10. A dispenser and applicator head (T) according to claim 7, wherein the mounting collar (3) includes an outer peripheral wall (31) that forms a shaped edge (30) that extends from the rear face (f2) to the front face (f1), the applicator pad (4) defining side edges (4*l*) and a bottom edge (4*i*) that meet the shaped edge (30) substantially without discontinuity, the applicator surface (41) projecting outwards relative to the shaped edge (30) so as to form a convex curve, at least along the longitudinal axis X.

11. A dispenser and applicator head (T) according to claim 7, wherein the applicator pad (4) is made out of polyurethane foam or out of elastomer with a surface treatment of the flocking type.

12. A fluid dispenser comprising a fluid dispenser unit (P) and a dispenser and applicator head (T) according to claim 1 wherein the dispenser unit (P) comprises a laterally-actuated pump that is provided with a stationary axial outlet (P2) on which the connector base (2) is mounted, and with a lateral pusher (P1) that is situated on the same side as the rear face (f2) of the dispenser and applicator head (T).

13. The dispenser and applicator head according to claim 1, wherein the dispenser unit is a pump.

14. The dispenser and applicator head according to claim 1, wherein the dispenser orifice is axially offset relative to the longitudinal axis, the longitudinal axis being a center axis of the dispenser.

* * * * *